US005735495A

United States Patent [19]

Kubota

[11] Patent Number: 5,735,495

[45] Date of Patent: Apr. 7, 1998

[54] TRASH BAG HOLDING DEVICE

[76] Inventor: Teresita Kubota, 9 Sara La., San Carlos, Calif. 94070

[21] Appl. No.: 731,970

[22] Filed: Oct. 23, 1996

Related U.S. Application Data

[60] Provisional application No. 60/016,407, Jun. 5, 1996.

[51] Int. Cl. [6] ..... B65B 67/04

[52] U.S. Cl. ..... 248/100; 24/546; 248/316.5; 248/316.7

[58] Field of Search ..... 248/95, 99, 100, 248/101, 97, 229.23, 229.13, 230.4, 316.5, 316.7; 24/543, 487, 518

[56] References Cited

U.S. PATENT DOCUMENTS

| | | | |
|---|---|---|---|
| 239,783 | 4/1881 | Hockensmith . | |
| 2,064,591 | 12/1936 | David | 24/543 |
| 2,710,732 | 6/1955 | Peters . | |
| 4,664,347 | 5/1987 | Brown et al. | 248/97 |
| 4,723,740 | 2/1988 | Courtemanche et al. | 248/95 |
| 4,735,340 | 4/1988 | Preston | 248/100 |
| 4,923,087 | 5/1990 | Burrows | 220/404 |
| 4,925,056 | 5/1990 | McColg | 220/404 |
| 4,997,149 | 3/1991 | Koch | 248/100 |
| 5,314,151 | 5/1994 | Carter-Mann | 248/100 |

FOREIGN PATENT DOCUMENTS 0 451 135 A1 10/1991 European Pat. Off. .

*Primary Examiner*—Ramon O. Ramirez
*Attorney, Agent, or Firm*—Richard C. Litman

[57] ABSTRACT

A device for holding a flexible bag, such as a plastic trash bag, inside a receptacle, such as a wastebasket or trash can. One or more of the devices may be used to hold a trash bag in a trash receptacle. The first embodiment of the invention has an U-shaped resilient clip with two opposing arms to be placed over the rim of a trash receptacle. The first arm has a flap with an extension that can snap into a cavity in the main body of the arm, between which a trash bag can be retained to secure it in the receptacle. The second arm has an end portion permanently connected by a hinge, and releasably connected by an extension that fits into a cavity in the main body of the arm, so that the end portion can swing out to release the clip from the receptacle, and swing in and be snapped in place to secure the clip to the receptacle. The second embodiment of the invention has a clipping portion by which it may be retained on a trash receptacle, and a snapping portion by which it may retain a trash bag. The snapping portion has an inner member and an outer member, which are joined by a flexible connecting member. In the center of the outer member is a female projection, which matingly engages a male projection in the center of the inner member, to more firmly hold the bag in place.

19 Claims, 6 Drawing Sheets

TRASH BAG HOLDING DEVICE

CROSS REFERENCE TO RELATED APPLICATION

This application is based on Provisional Patent Application Ser. No. 60/016,407, filed Jun. 5, 1996.

BACKGROUND OF THE INVENTION

1. Field of the Invention

The present invention relates to devices for retaining bags in containers.

2. Description of the Prior Art

The customary way of lining trash cans with plastic bags is to fold the bag over the rim of the can. This method is unsightly and may hide decorative features on the can. The present invention has a clipping portion that fits over the rim of the can, and a snapping portion by which the edge of the opening of the bag may be retained against the rim.

U.S. Pat. No. 239,783, issued on Apr. 5, 1881, to William H. Hockensmith, discloses a bag holder, having a pair of pivotally connected clamping bars between which the handle of a bag may be pivotally gripped. The instant invention is distinguishable in that it includes a combination of an elastic clip with a snapping device having an asymmetrical pair of matingly engaging members.

U.S. Pat. No. 2,710,732, issued on Jun. 14, 1955, to Leo Peters, discloses a lock support for containers, having a rod with pins that pass through holes in a container such as a clothing bag, where the holes for the pins are near the opening of the bag, so that the bag may be secured to a surface such as a door in such a manner that its contents cannot be removed. The instant invention is distinguishable, in that it is designed to hold a trash bag in another container.

U.S. Pat. No. 4,723,740, issued on Feb. 9, 1988, to Richard Courtemanche and Timothy D. McCormack, discloses a pair of support hooks for a plastic bag with two opposite handles forming cutouts. The instant invention does not require that the bag have handles or cutouts.

U.S. Pat. No. 4,735,340, issued on Apr. 5, 1988, to John H. Preston, discloses trash bag brackets for retaining and supporting limp plastic bags as liners in trash receptacles, with handles on the plastic bags being retained on the brackets. The instant invention is distinguishable, in that it has a snapping device and does not require the plastic bag to have handles.

U.S. Pat. No. 4,923,087, issued on May 8, 1990, to Roger A. Burrows, discloses a trash storage and disposal combination unit, with hooks on outside surface of the trash container by which handles of the bag are held, with the bag passing over and covering the rim of the container. The instant invention is distinguishable, in that the holder is separate from the container, handles on the bag are not required, and the bag need not pass over the rim of the container.

U.S. Pat. No. 4,925,056, issued on May 15, 1990, to James E. McColg, discloses clips for holding a plastic bag in a trash can, which do not include a snapping device, as does the instant invention.

U.S. Pat. No. 4,997,149, issued on Mar. 5, 1991, to Steven L. Koch, discloses a plastic bag support, having a plastic strip with outwardly projecting ears, which is hooked over and supported on the rim of a trash container. Unlike the instant invention, it does not have a snapping device, and the plastic bag must have handles.

U.S. Pat. No. 5,314,151, issued on May 24, 1994, to Candice Carter-Mann, discloses a plastic bag hanger device to be placed on the rim of a trash receptacle, having clip members, but not snapping devices, which requires that the plastic bags have handles.

European Patent Application No. 0 451 135 A1, published October 1991, discloses holding devices for sacks, which do not have a snapping mechanism as in the instant invention.

None of the above inventions and patents, taken either singly or in combination, is seen to describe the instant invention as claimed.

SUMMARY OF THE INVENTION

The first preferred embodiment of the present invention has three parts: an U-shaped resilient clip with two opposing arms to be placed over the rim of a trash receptacle. The first arm has a flap with a male portion that can snap into a female portion on the main body of the arm, between which a trash bag can be retained to secure it in the receptacle. The second arm has an end portion permanently connected by a hinge to the rest of the arm, and releasably connected by a second male portion that fits into a to second female portion on the main body of the arm, so that the end portion can swing out to release the clip from the receptacle, and swing in and be snapped in place to secure the clip to the receptacle. The second preferred embodiment of the present invention has two parts: an one-piece U-shaped resilient clip to be placed over the rim of a trash receptacle, and on one side of the clamp, a snapping device to hold a trash bag. The snapping device has two parts attached on one side, which can be matingly engaged in a closed position to secure the bag, and can be opened to release the bag so that it can be removed and replaced.

Accordingly, it is a principal object of the invention to provide a new and improved means of retaining a trash bag in a trash receptacle.

It is another object of the invention to provide a means for retaining a bag without handles or apertures other than one opening, in a trash receptacle.

It is a further object of the invention to provide a means of retaining a trash bag in a trash receptacle in such a manner that the upper edge of the bag does not go over the rim of the receptacle.

Still another object of the invention is to provide a trash bag holder that may be decorative.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a device for holding a flexible bag, such as a plastic trash bag, inside a receptacle, such as a wastebasket or trash can.

Figure 1:
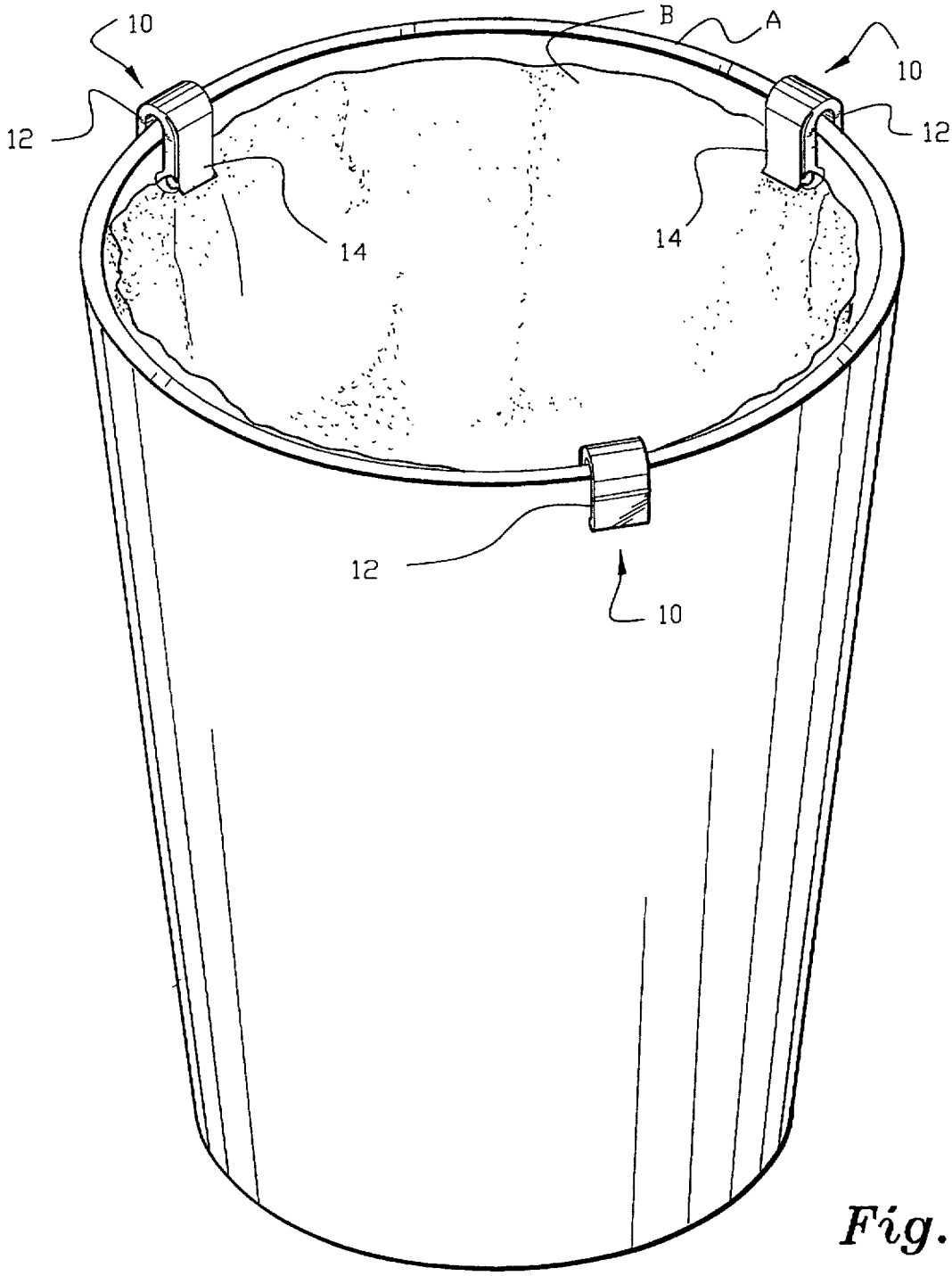
FIG. 1 is an environmental perspective view of the first embodiment of the invention in use to hold a trash bag in a trash receptacle.

FIG. 1 is an environmental perspective view of three trash bag holders of the first embodiment 10 in use to hold a trash bag B in a trash receptacle A. Each holder has a receptacle holding portion 12 and a bag holding portion 14. Both portions are made of a flexible, resilient material.

Figure 2:
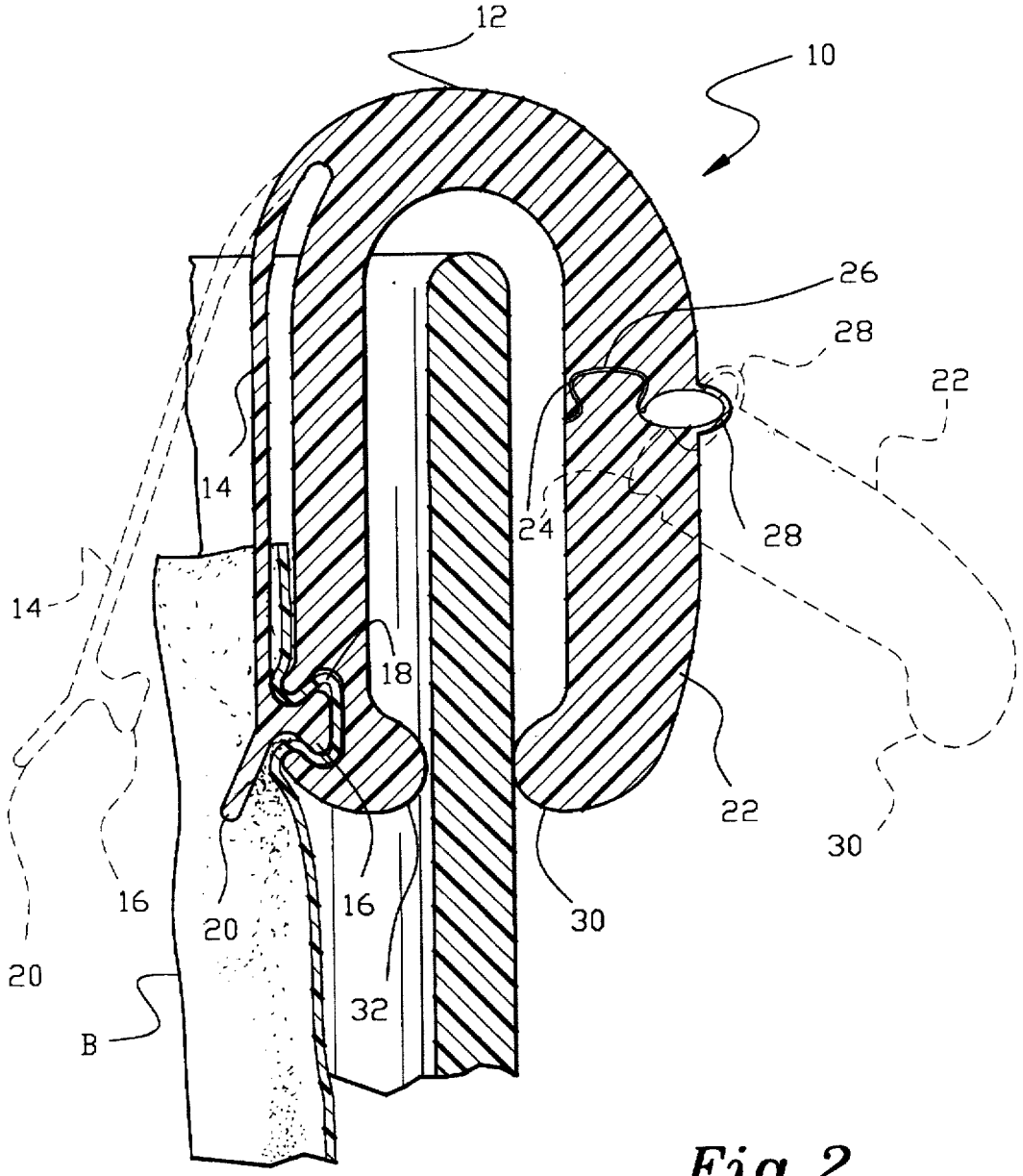
FIG. 2 is a detail view in section of the first embodiment of the invention, showing how it is retained on a trash receptacle while retaining a trash bag.

FIG. 2 is a detail view in section of one trash bag holder of the first embodiment 10, showing how it is retained on a trash receptacle A by the receptacle holding portion 12 while retaining a trash bag B by the bag holding portion 14. The bag holding portion is shown in a an engaged position in solid lines, and in a released position in broken lines. The bag holding portion has an extension 16 that snaps into a first cavity 18 in the receptacle holding portion, between which the bag is retained. There is a tab 20 at the end of the bag holding portion, to make it easier to release the bag. Opposite from the bag holding portion, the receptacle holding portion has a releasable arm 22, which is shown in a an engaged position in solid lines, and in a released position in broken lines. The releasable arm has an extension 24 that snaps into a second cavity 26. The releasable arm is permanently attached by a flexible connecting member 28. The sides of the receptacle are gripped between the outer end 30 and inner end 32 of the receptacle holding portion.

Figure 3:
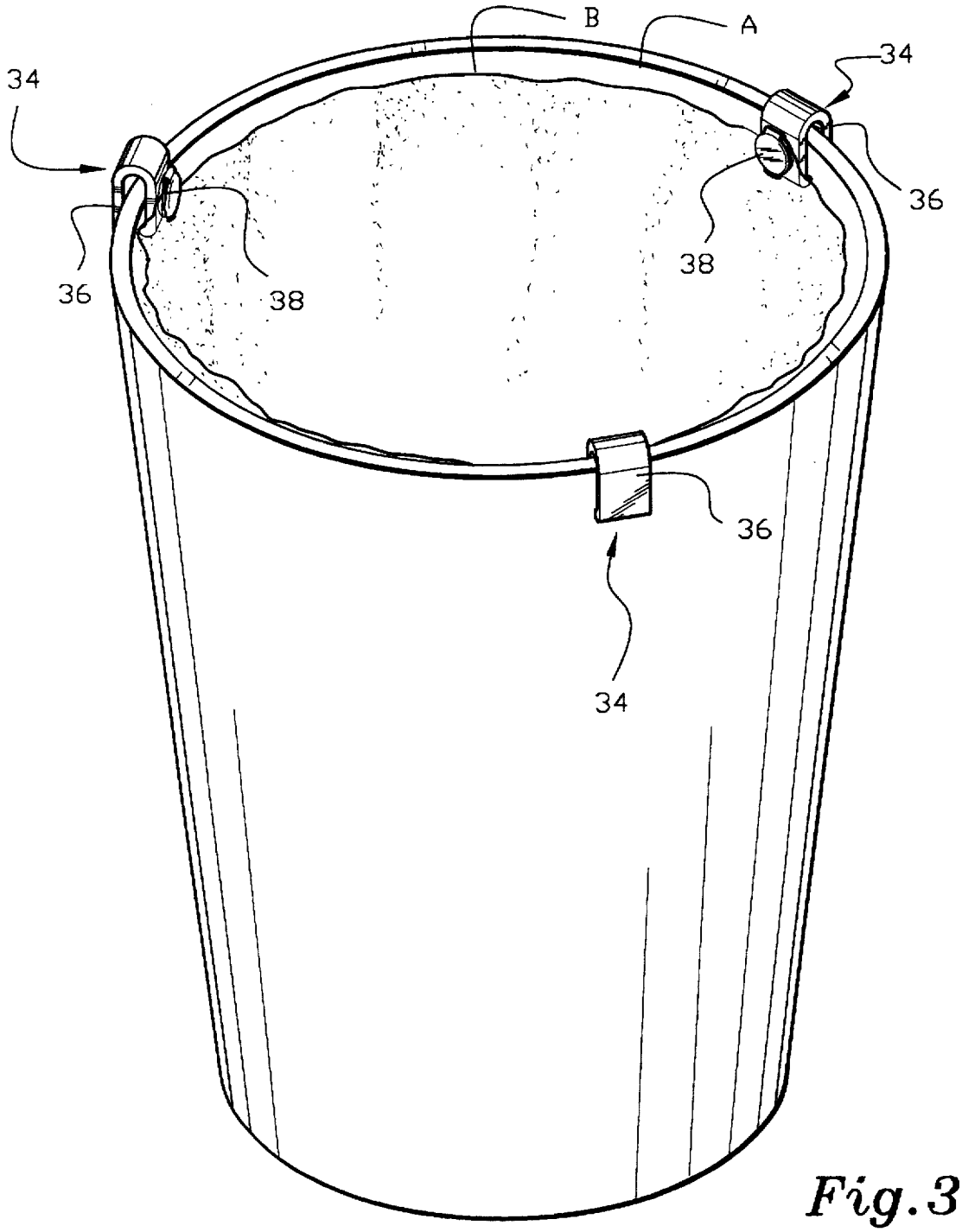
FIG. 3 is an environmental perspective view of the second embodiment of the invention in use to hold a trash bag in a trash receptacle.

FIG. 3 is an environmental perspective view of three trash bag holders 34 in use to hold a trash bag B in a trash receptacle A. Each holder has a clipping portion 36 and a snapping portion 38.

Figure 4:
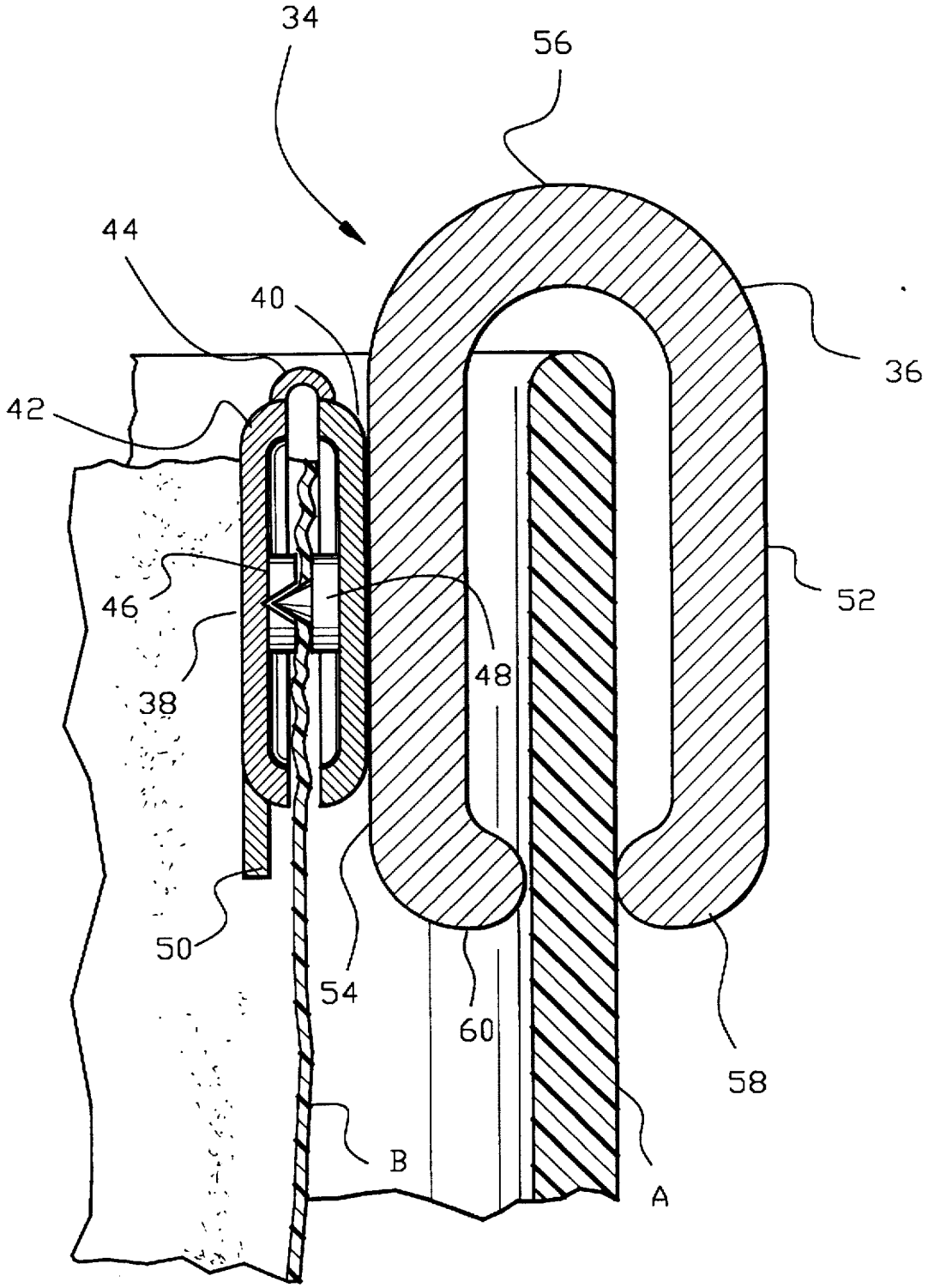
FIG. 4 is a detail view in section of the second embodiment of the invention, showing how it is retained on a trash receptacle while retaining a trash bag.

FIG. 4 is a detail view in section of one trash bag holder 34, showing how it is retained on a trash receptacle by clipping portion 36 while retaining a trash bag by snapping portion 38. The snapping portion has an inner member 40 and an outer member 42, which are joined by a flexible connecting member 44. Alternatively, the inner and outer members may be pivotally joined (not shown in drawings). In the center of the outer member is a female projection 46, which matingly engages a male projection 48 in the center of the inner member, to more firmly hold the bag in place. A tab 50 projects from the outer member oppositely from the connecting member 44, to make it easier for an user to open the snapping portion when the user desires to remove the bag. The clipping portion is made of a resilient material, with an outer arm 52, an inner arm 54 to which the inner member of the snapping portion is joined, and an U-shaped connecting region 56 which provides tension to push the arms together when placed over the rim of the receptacle the arms are outwardly displaced from their resting position, so that they grip the side of the receptacle at inward projections 58 and 60.

Figure 6:
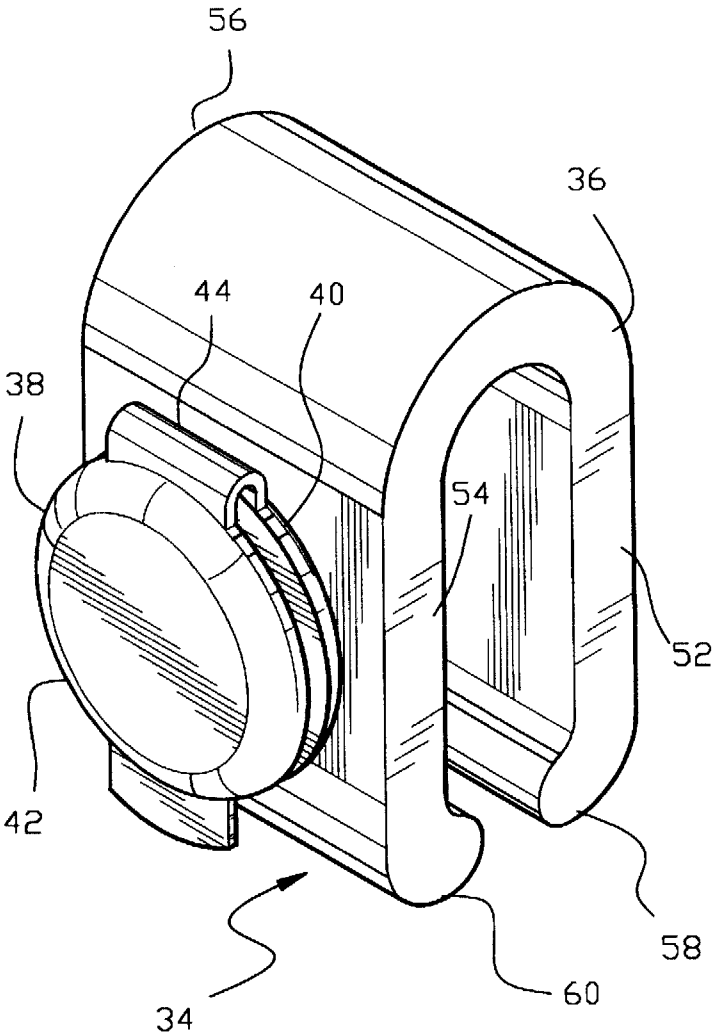
FIG. 6 is a perspective view of the second embodiment of the invention with the snapping device in a closed position.
Figure 5:
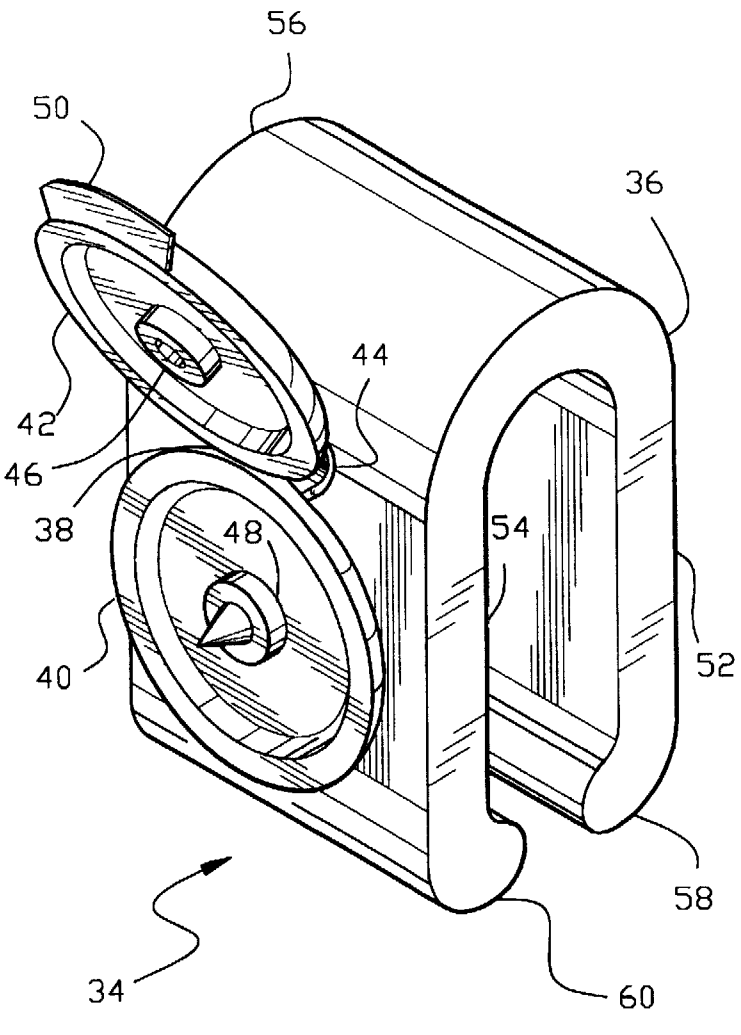
FIG. 5 is a perspective view of the second embodiment of the invention with the snapping device in an open position.

FIG. 5 is a perspective view of the invention with the snapping device in an open position. It can be seen in this figure that both the inner member 40 and the outer member 42 of the snapping portion 38 are approximately disk-shaped and of about the same size. FIG. 6 is a perspective view of the invention with the snapping device in a closed position. The snapping portion is made of a resilient material so that the inner and outer members can be slightly but reversibly deformed when pushed together, so as to be matingly engaged in a closed position.

Figure 7:
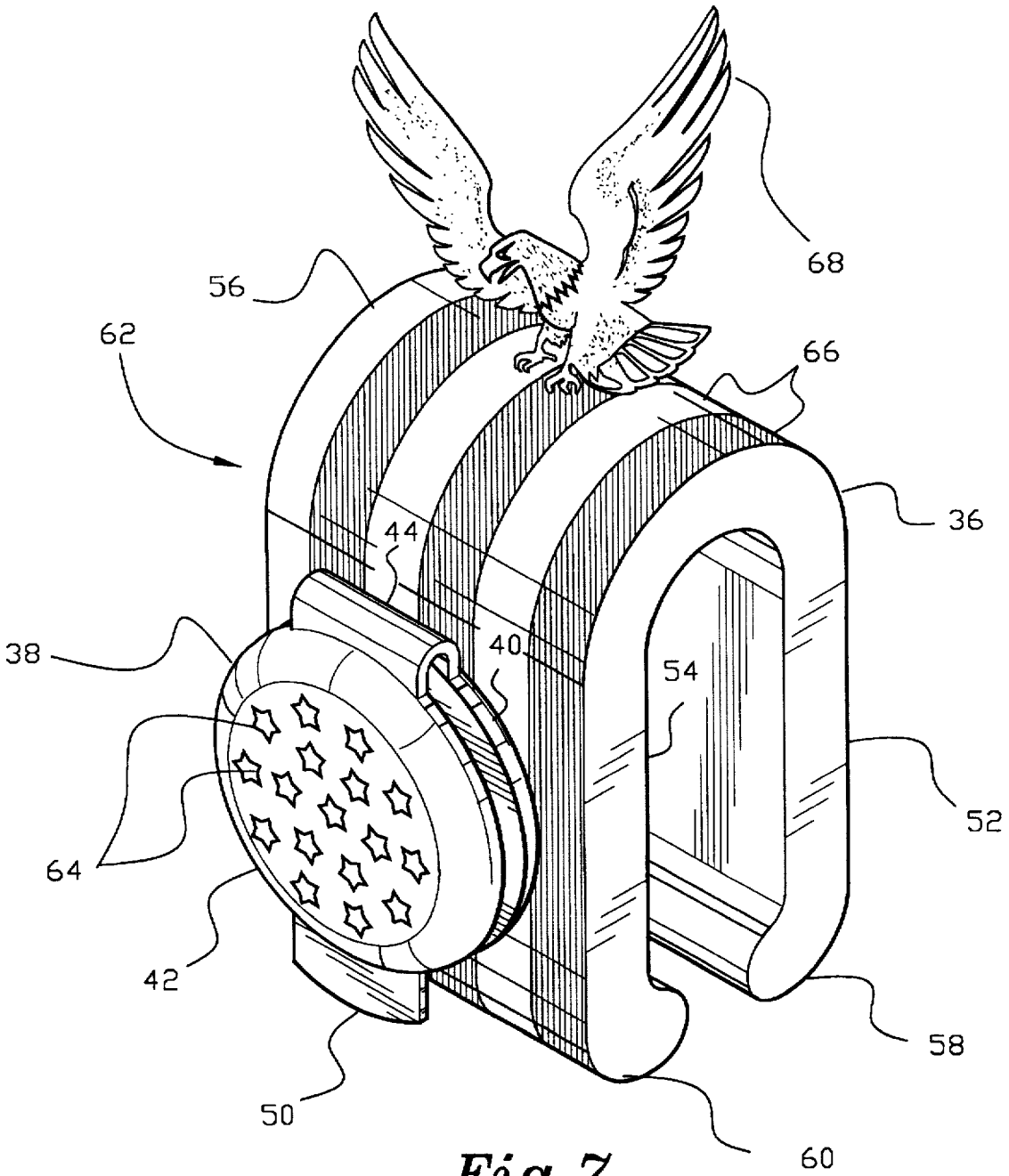
FIG. 7 is a perspective view of the third embodiment of the invention.

FIG. 7 is a perspective view of the third embodiment of the invention 62, which is the same as the second embodiment, except that decorative features have been added. Colored or sculptured patterns may be painted on or embedded in the surface of the trash bag holder, which may match patterns on a receptacle. In this example, the outer surface of the outer member of the snapping portion has stars 64, the outer surface of the clipping portion has stripes 66, and a sculpture in the form of an eagle 68 is attached to the upper surface of the connecting region 56. As can be appreciated from FIG. 7, the decoration shown extends to the entire exterior surface of the holder, and thus covers the outer surfaces of both the inner arm 54 and the outer arm 52.

It is to be understood that the present invention is not limited to the embodiments described above, but encompasses any and all embodiments within the scope of the following claims.

I claim:

1. A holding device, comprising:

a main portion having a first arm and a second arm, said first arm and said second arm being biased inward when outwardly displaced from a resting position, said main portion being retained on a first object;

said second arm having an end portion movable between an open position and a closed position, said end portion being permanently attached to an inner portion of the second arm by a flexible member, and said end portion having an extension matingly and releasably attached to a cavity in said inner portion; and a flap attached to said first arm and movable between an open position and a closed position with respect to said first arm, said flap having an extension fittable into a cavity in said first arm when in the closed position, wherein a second object is retained between said flap and said first arm when said flap is in the closed position.

2. The holding device according to claim 1, wherein said first arm and said second arm of said main portion are joined by a connecting region made of a resilient material.

3. The holding device according to claim 2, wherein said first arm and said second arm of said main portion have inward projections on their ends opposite said connecting region.

4. The holding device according to claim 3, wherein said connecting region is U-shaped.

5. A plurality of holding devices for retaining a trash bag onto and within an open refuse container, said holding devices being dimensioned and configured to be distributed approximately evenly about the open trash container, each device comprising:

a clipping portion, having a pair of opposing arms that are biased inward when outwardly displaced from a resting position, whereby the device can be retained on a lip of a refuse receptacle; and a snapping portion attached to the clipping portion, having a pair of matingly engageable members, between which an edge of a trash bag is retained when the members are in a closed position, and from which the trash bag edge is released when the members are in an open position.

6. A holding device, comprising:

a clipping portion, having a pair of opposing arms that are biased inward when outwardly displaced from a resting position, whereby the device can be retained on a first object; and a snapping portion attached to the clipping portion, having a pair of matingly engageable members, between which a second object can be retained when the members are in a closed portion, and from which the second object can be released when the members are in an open position.

7. The holding device according to claim 6, wherein the arms of the clipping portion are joined by a connecting region made of a resilient material that imparts the inward bias to the arms when they are outwardly displaced from the resting position.

8. The holding device according to claim 7, wherein the arms of the clipping portion have inward projections on their ends opposite the connecting region.

9. The holding device according to claim 8, wherein the arms of the clipping portion are rectangular.

10. The holding device according to claim 9, wherein the connecting region joining the arms of the clipping portion is U-shaped.

11. The holding device according to claim 6, wherein the pair of matingly engageable members of the snapping portion are joined by a flexible connecting member.

12. The holding device according to claim 11, wherein the pair of matingly engageable members of the snapping portion are approximately disk-shaped, with inner surfaces and outer surfaces, with a first matingly engageable member having a male projection from its inner surface, and a second matingly engageable member having a female projection from its inner surface.

13. The holding device according to claim 11, wherein there is a tab projecting from one of the pair of matingly engageable members of the snapping portion, on a side opposite from the flexible connecting member.

14. The holding device according to claim 6, wherein the pair of matingly engageable members of the snapping portion are pivotally joined.

15. The holding device according to claim 14, wherein the pair of matingly engageable members of the snapping portion are approximately disk-shaped, with inner surfaces and outer surfaces, with a first matingly engageable member having a male projection from its inner surface, and a second matingly engageable member having a female projection from its inner surface.

16. The holding device according to claim 14, wherein there is a tab projecting from one of the pair of matingly engageable members of the snapping portion, on a side opposite from a side on which the members are pivotally joined.

17. The holding device according to claim 6, wherein one arm of the clipping portion is attached to one member of the snapping portion.

18. The holding device according to claim 6, wherein there are decorative designs on the surface of the holding device.

19. The holding device according to claim 6, wherein there are three-dimensional designs attached to the surface of the holding device.

* * * * *